US008176907B2

(12) United States Patent
Wei

(10) Patent No.: US 8,176,907 B2
(45) Date of Patent: May 15, 2012

(54) PROJECTILE-LOADING ASSEMBLY FOR AIR-POWERED GUN

(76) Inventor: Ho-Sheng Wei, Taipei Hsien (TW)

( * ) Notice: Subject to any disclaimer, the term of this patent is extended or adjusted under 35 U.S.C. 154(b) by 281 days.

(21) Appl. No.: 12/766,785

(22) Filed: Apr. 23, 2010

(65) Prior Publication Data

US 2011/0259312 A1 Oct. 27, 2011

(51) Int. Cl.
*F41B 11/02* (2006.01)

(52) U.S. Cl. ..... 124/53; 124/45; 124/52; 124/73

(58) Field of Classification Search ..... 124/45, 124/51.1, 52, 53, 73, 74
See application file for complete search history.

(56) References Cited

U.S. PATENT DOCUMENTS 5,477,843 A * 12/1995 Kunimoto ..... 124/73
5,711,286 A * 1/1998 Petrosyan et al. ..... 124/73
7,415,977 B2 * 8/2008 Chen ..... 124/74
7,726,293 B2 * 6/2010 Wei ..... 124/74
7,766,000 B2 * 8/2010 Maeda ..... 124/74
7,950,382 B2 * 5/2011 Maeda ..... 124/73
2009/0320817 A1 * 12/2009 Huang ..... 124/53
2010/0170492 A1 * 7/2010 Tiberius et al. ..... 124/74

* cited by examiner

*Primary Examiner* — John Ricci
(74) *Attorney, Agent, or Firm* — Chun-Ming Shih; HDLS IPR Services

(57) ABSTRACT

A projectile-loading assembly (1) for an air-powered gun is configured to load projectiles (3) in a barrel (4) and includes a magazine module (10) and a slider module (20). The magazine module (10) includes a projectile chamber (11), a rail tube (14) located over the projectile chamber (11) to be aligned with the barrel (4), and a projectile-loading block (15) sheathed the rail tube (14). The slider module (20) slides with respect to the barrel (4) and includes: a spring (21) for pushing the projectile-loading block (15) to depart from the barrel (4), and an elastic piece (22) for pushing the projectile-loading block (15) to approach the barrel (4). The elastic piece (22) pushes the projectile-loading block (15) to slide toward the barrel (4) when the slider module (20) slides forwards, thereby pushing one projectile (3) into the barrel (4) while closing the projectile chamber (11).

7 Claims, 5 Drawing Sheets

PROJECTILE-LOADING ASSEMBLY FOR AIR-POWERED GUN

BACKGROUND OF THE INVENTION

1. Field of the Invention

The present invention relates to an air-powered gun, and in particular to a projectile-loading assembly for an air-powered gun.

2. Description of Prior Art

Since more and more people pay attention to enjoy their leisure time, shooting projectiles (sham bullets) (such as BB balls or paintballs) has become a popular outdoor activity for modern people. Such a gun is usually powered by compressed air to thereby shoot the projectiles received in a magazine. A spring-biased projectile-pushing rod is provided in the magazine, whereby the projectiles in the magazine can be pushed into the breech of the barrel.

However, conventionally, since no mechanism is provided around the breech for controlling the loading of projectiles, the projectile-pushing rod may push several projectiles in the breech in one time, which causes the jam of projectiles. Especially, when the user tilts the muzzle of the gun downwards, more projectiles may be jammed into the breech due to their gravity. Even, the firing mechanism of the air-powered gun may break down.

Therefore, it is an important issue for the present Inventor to solve the above-mentioned problems.

SUMMARY OF THE INVENTION

An object of the present invention is to provide a projectile-loading assembly for an air-powered gun, which is capable of loading projectiles one by one into the same position of the breech, thereby increasing the positional consistency of the projectiles in the breech and the shooting average while closing a projectile chamber of a magazine to prevent the jam of projectiles.

To accomplish the above object, the present invention is to provide a projectile-loading assembly for an air-powered gun, configured to load projectiles one by one into a barrel of the air-powered gun and comprising: a magazine module comprising a projectile chamber for accommodating the projectiles, a rail tube located over the projectile chamber to be aligned with the barrel, and a projectile-loading block sheathed the rail tube; and a slider module for sliding forwards or rearwards with respect to the barrel, the slider module comprising: a spring for pushing the projectile-loading block to depart from the barrel, and an elastic piece for pushing the projectile-loading block to approach the barrel; wherein the elastic piece pushes the projectile-loading block to slide toward the barrel along the rail tube when the slider module slides forwards, thereby pushing one projectile into the barrel while closing the projectile chamber.

In comparison with prior art, the present invention has advantages features as follows. Since the magazine module has the projectile-loading block and the slider module can push the projectile-loading block to reciprocate when the slider module reciprocates with respect to the barrel, the projectile-loading block opens the projectile chamber when it slides rearwards to depart from the breech. At this time, the projectile in the projectile chamber can be pushed out of the projectile chamber by a spring-biased projectile-pushing rod provided therein. When the projectile-loading block slides toward the breech, it pushes the projectile into the breech and closes the projectile chamber, thereby preventing other projectiles from entering the breech. Therefore, only one projectile can be loaded into the breech in one time. Furthermore, the projectile can be loaded into the beech at the same position every time, thereby increasing the positional consistency of the projectile in the breech and the shooting average while reducing the possibility of the jam of projectiles.

DETAILED DESCRIPTION OF THE INVENTION

Figure 1:
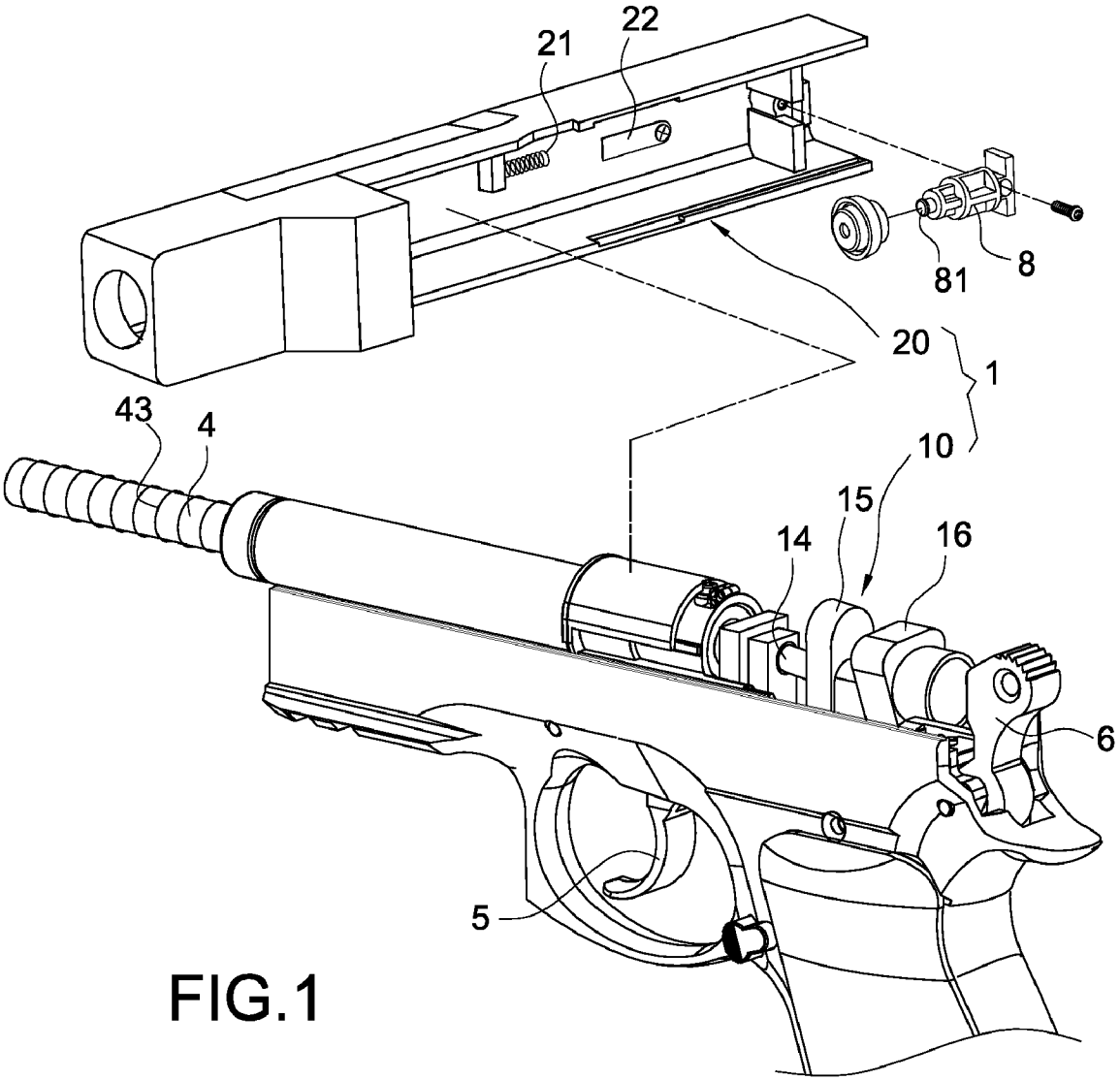
FIG. 1 is an exploded perspective view of the present invention.
Figure 2:
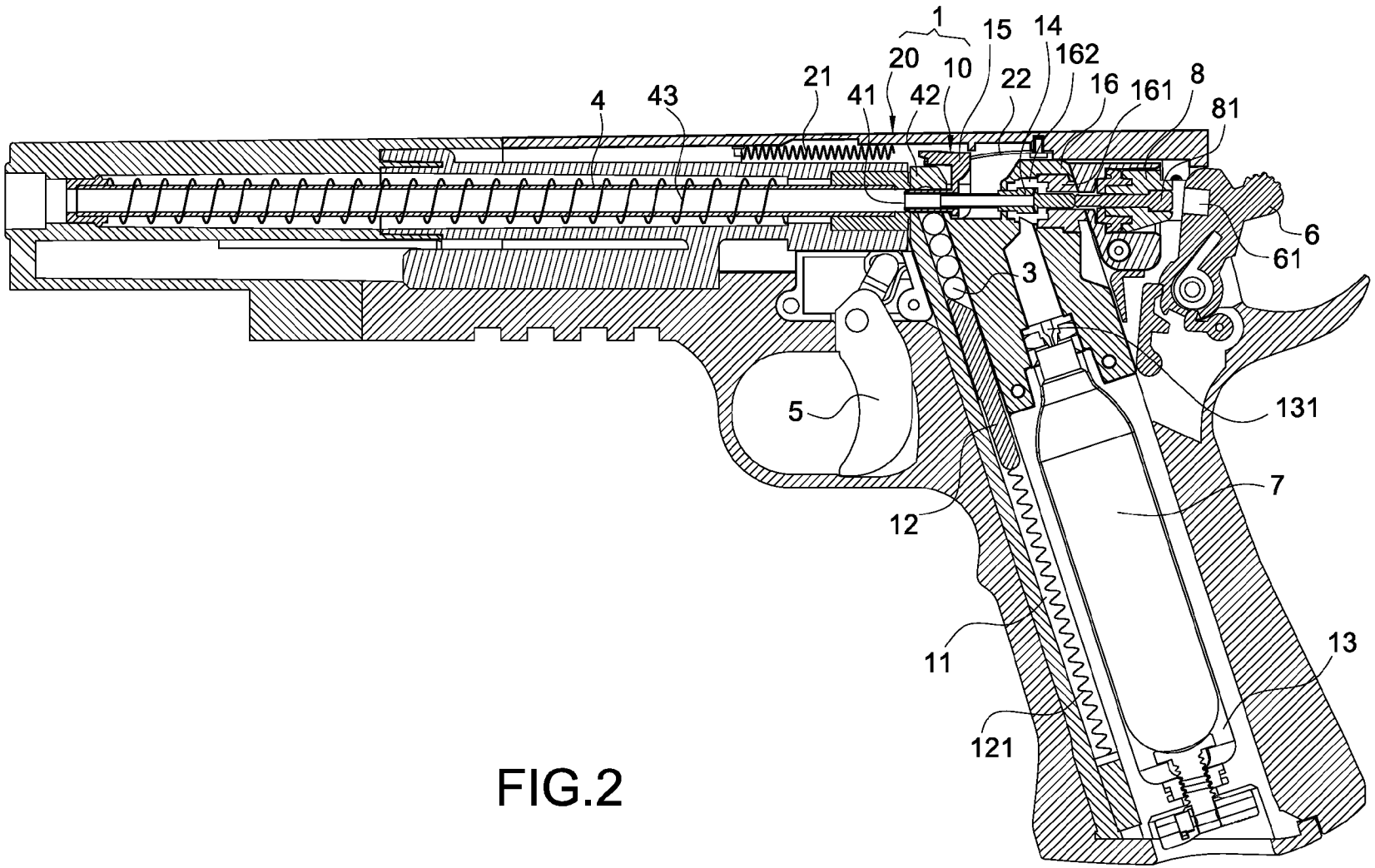
FIG. 2 is an assembled cross-sectional view of the present invention, showing that a projectile has not been loaded into a breech of a gun.

Please refer to FIGS. 1 and 2. The present invention provides a projectile-loading assembly 1 for an air-powered gun, which is configured to load a projectile 3 into a breech 41 of a barrel 4 of the air-powered gun. The projectile-loading assembly 1 includes a magazine module 10 and a slider module 20.

As shown in FIG. 2, the barrel 4 is formed into a hollow tube. The front opening of the barrel 4 is referred to as a muzzle, and the rear opening thereof is referred to as the breech 41. The upper edge of the breech 41 is formed with a protrusion 42 for blocking the projectile 3 from going beyond the upside of the barrel 4.

The magazine module 10 is inserted from the bottom of a grip of the air-powered gun into its main body. The magazine module 10 has a projectile chamber 11 for accommodating projectiles 3. The interior of the projectile chamber 11 is provided with a projectile-pushing rod 12. The projectile-pushing rod 12 is biased by a spring 121 toward the top of the projectile chamber 11. Since the upper edge of the rear end of the barrel 4 is formed with the protrusion 42, the projectile 3 pushed out of the projectile chamber 11 by the projectile-pushing rod 12 can be blocked from going beyond the upside of the barrel 4.

The interior of the magazine module 10 is provided adjacent to the projectile chamber 11 with an accommodating chamber 13 for receiving a compressed air can 7. The magazine module 10 is provided with an intake tube 131 at the top of the accommodating chamber 13. When the compressed air can 7 is received in the accommodating chamber 13, the intake tube 131 punctures the top of the compressed air can 7, so that the high pressurize air in the can 7 can pass through the intake tube 131 to the outside of the can 7. With regard to the principle of firing projectiles by the air-powered gun, the description relating thereto will be made later.

Figure 3:
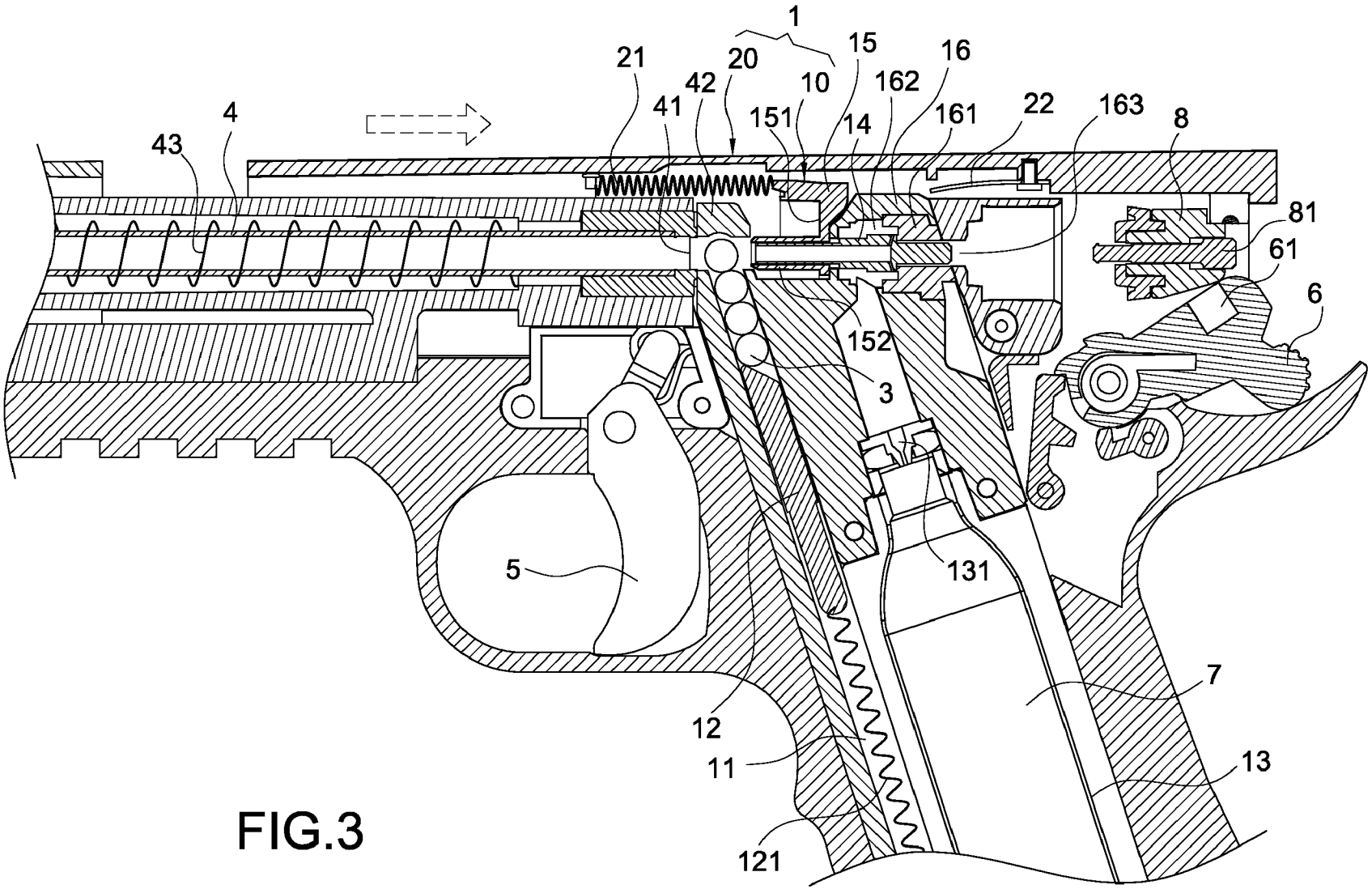
FIG. 3 is an assembled cross-sectional view of the present invention, showing that a slider module slides rearwards to depart from the breech to drive a projectile-loading block to open a projectile chamber.

Please refer to FIG. 3. The top of the magazine module 10 is provided with a rail tube 14. When the magazine module 10 is inserted into the main body of the air-powered gun, the rail tube 14 on the top of the magazine module 10 is aligned with the breech 41 of the barrel 4. One end of the rail tube 14 adjacent to the breech 41 is sheathed with a projectile-loading block 15 for sliding forwards or rearwards along the rail tube 14. The front end surface of the projectile-loading block 15 is provided with a trough 151. The profile of the trough 151 corresponds to that of the protrusion 42 of the barrel 4. The bottom of the projectile-loading block 15 is formed with a projectile-loading protrusion 152. As shown in FIG. 2, when the projectile-loading block 15 is located at the front end of the rail tube 14, the trough 151 of the projectile-loading block 15 is engaged with the protrusion 42 of the barrel 4, so that the projectile-loading protrusion 152 of the projectile-loading block 15 can close the top opening of the projectile chamber 11. At this time, the projectiles 3 in the projectile chamber 11 cannot be pushed out by the projectile-pushing rod 12.

The top of the magazine module 10 is further provided with an intake portion 16 away from the projectile-loading block 15. The interior of the intake portion 16 has a valve 161 for selectively contacting with the rail tube 14 or separating there from, and an intake chamber 162 surrounding the rail tube 14. The compressed air in the can 7 is filled in the intake chamber 162 via the intake tube 131. However, when the rail tube 14 is brought into tight contact with the valve 161, the compressed air cannot be leaked via the intake chamber 162.

The slider module 20 is assembled to an upper portion of the air-powered gun. A spring 43 is sheathed on the front end of the barrel 4, whereby the slider module 20 can slide forwards and rearwards with respect to the barrel 4. The inner wall of the slider module 20 is provided with a spring 21 and an elastic piece 22. As shown in FIG. 2, the spring 21 is located in front of the projectile-loading block 15 and extends rearwards, so that the spring 21 can push the front end of the projectile-loading block 15 to move rearwards when the slider module 20 slides rearwards, so that the projectile-loading protrusion 152 departs from the breech 42. At this time, the projectile chamber 11 is opened, so that the projectile 3 can be pushed out of the projectile chamber 11 by the projectile-pushing rod 12 and blocked by the protrusion 42 of the barrel 4.

On the other hand, the elastic piece 22 is located in rear of the projectile-loading block 15 and extends forwards, so that the elastic piece 22 can push the rear end of the projectile-loading block 15 to move forwards when the slider module 20 slides forwards, so that the projectile-loading protrusion 152 can be inserted into the breech 42. In this way, the projectile-loading protrusion 152 closes the projectile chamber 11 and pushes the projectile 3 that has been pushed out of the projectile chamber 11 into the breech 41, while preventing other projectiles 3 from being pushed out of the projectile chamber 11 by the projectile-pushing rod 12.

The rear end of the slider module 20 is fixedly connected with a piston 8, so that the piston 8 can reciprocate synchronously with the slider module 20. The interior of the piston 8 has a firing pin 81 for pushing the rail tube 14 to be separated from the valve 161. The rear end surface of the intake portion 16 of the magazine module 10 is provided with a perforation 163. The firing push 81 of the piston 8 penetrates the perforation 163 to push the rail tube 14. The rear end of the air-powered gun is pivotally connected with a striking hammer 6. The front end surface of the striking hammer 6 is provided with a striking portion 61 for striking the firing pin 81 of the piston 8.

Next, the operation of the projectile-loading assembly 1 of the present invention will be described with reference to FIGS. 3 to 5.

As shown in FIG. 3, when the slider module 20 slides rearwards, the spring 21 pushes the front end of the projectile-loading block 15 to slide rearwards to depart from the breech 42. As a result, the projectile chamber 11 is opened to allow the projectile 3 to be pushed out of the projectile chamber 11 by the projectile-pushing rod 12. At the same time, the piston 8 fixedly connected to the rear end of the slider module 20 is moved rearwards to press the striking hammer 6, so that the striking hammer 6 rotates clockwise into a cocking position.

Figure 4:
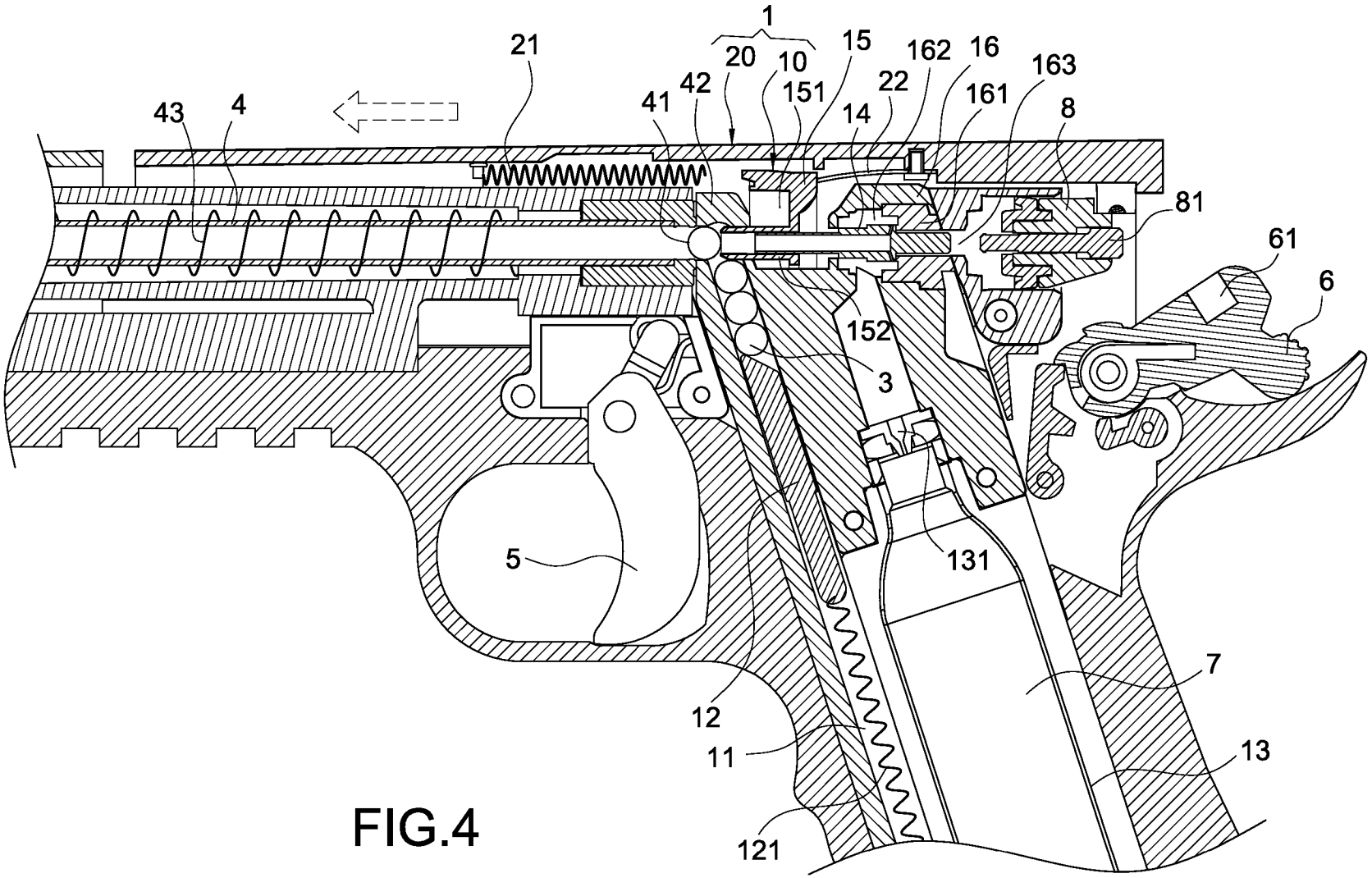
FIG. 4 is an assembled cross-sectional view of the present invention, showing that the slider module slides forwards to approach the breech to drive the projectile-loading block to push a projectile into the breech and close the projectile chamber.

As shown in FIG. 4, since the front end of the barrel 4 is sheathed with a spring 43, the slider module 20 can return to its original position by the elastic restoring force of the spring 43 after the slider module 20 slides rearwards. At this time, the elastic piece 22 pushes the rear end of the projectile-loading block 15 to slide forwards, so that the projectile-loading protrusion 152 can be inserted into the breech 42. In this way, the projectile-loading protrusion 152 closes the projectile chamber 11 and pushes the projectile 3 that has been pushed out of the projectile chamber 11 into the breech 41, while preventing other projectiles 3 from being pushed out of the projectile chamber 11 by the projectile-pushing rod 12. At the same time, the piston 8 located in rear of the slider module 20 is also moved forwards together with the slider module 20 to approach the rail tube 14 of the magazine module 10.

Figure 5:
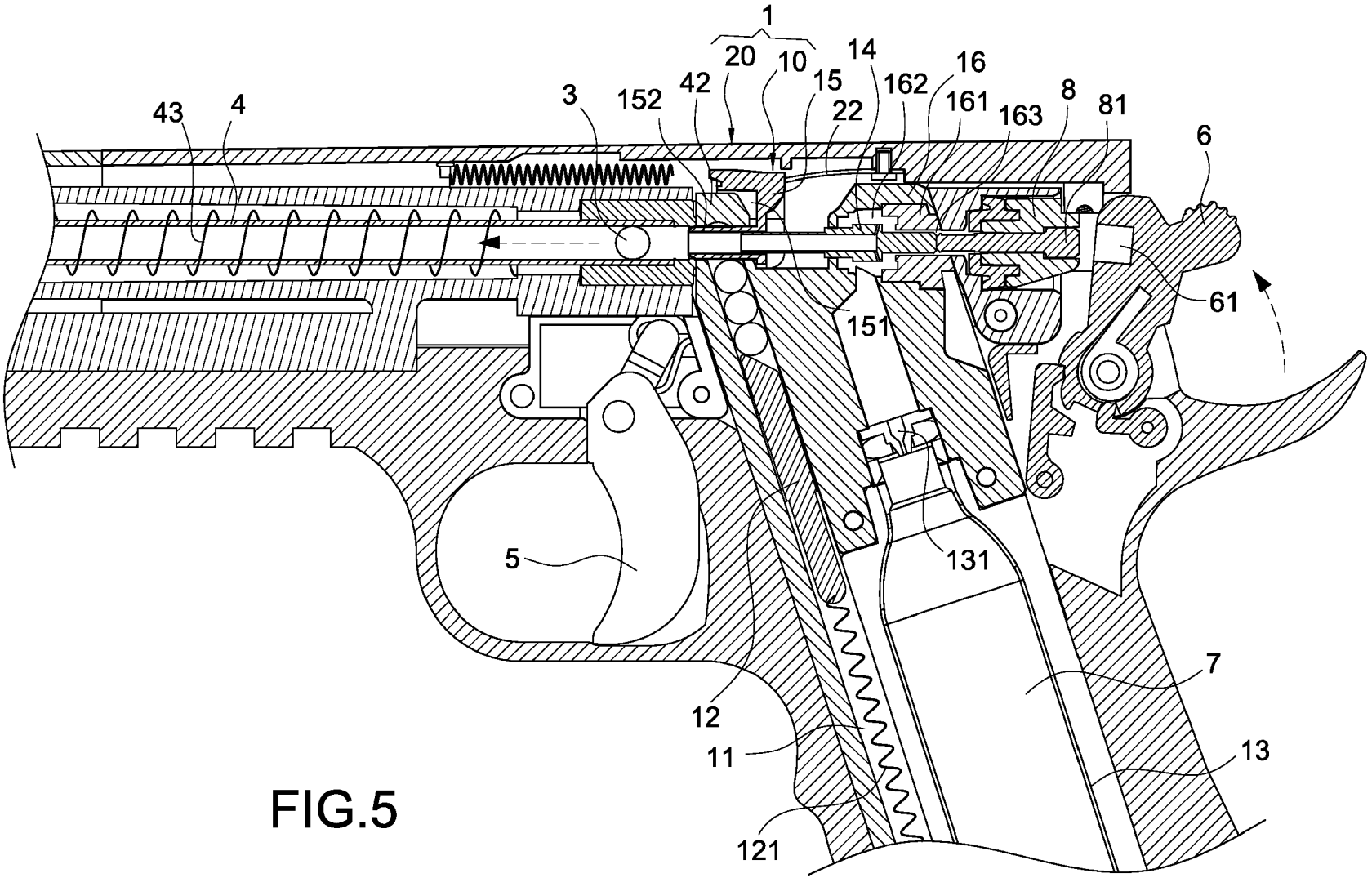
FIG. 5 is an assembled cross-sectional view of the present invention showing the firing of a projectile.

As shown in FIG. 5, when the user presses a trigger 5 to release the striking hammer 6, the striking hammer 6 will rotate counterclockwise (indicated by the dashed arrow on the right side of FIG. 5) by means of the elastic restoring force of a torsion spring (not shown) mounted on a shaft (not shown) of the striking hammer 6. In this way, the striking portion 61 of the striking hammer 6 strikes the firing pin 81 of the piston 8. When the firing pin 81 moves forwards to strike the rail tube 14, the rail tube 14 can be forced to move forwards to separate from the valve 161 of the intake portion 16. At this time, a portion of the compressed air in the intake chamber 162 will enter the rail tube 14 via the gap between the contact surfaces of the rail tube 14 and the valve 161. Since the rail tube 14 is aligned with the breech 42, the portion of the compressed air entering the rail tube 14 can propel the projectile 3 out of the barrel 4.

Furthermore, the other portion of the compressed air filled in the intake chamber 162 is ejected rearwards via the perforation 162 of the intake portion 16, thereby propelling the piston 8 to move rearwards. Since the piston 8 is fixedly connected to the slider module 20, the rearward movement of the piston 8 can drive the slider module 20 to slide rearwards to press the striking hammer 6 again. As a result, the striking hammer 6 is forced to rotate clockwise to the cocking position shown in FIG. 3. At this time, since the slider module 20 slides rearwards, the spring 21 of the slider module 20 pushes the projectile-loading block 15 of the magazine module 10 to move rearwards, thereby opening the projectile chamber 11 and allowing the next projectile 3 to be pushed out of the projectile chamber 11 by the projectile-pushing rod 12. By repeating the steps of FIGS. 3 to 5, when the user first presses the striking hammer 6 or slides rearwards the slider module 20 with respect to the barrel 4 to press the striking hammer 6, he/she can shoot the projectiles 3 continuously under the control of the trigger 5.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A projectile-loading assembly (1) of an air-powered gun for loading projectiles (3) one by one into a barrel (4) of the air-powered gun and comprising:

a magazine module (10) comprising a projectile chamber (11) for accommodating the projectiles (3), a rail tube (14) located over the projectile chamber (11) to be aligned with the barrel (4), and a projectile-loading block (15) slidably mounted on the rail tube (14); and a slider module (20) for sliding forwards or rearwards with respect to the barrel (4), the slider module (20) comprising: a spring (21) for pushing the projectile-loading block (15) to depart from the barrel (4), and an elastic piece (22) for pushing the projectile-loading block (15) to approach the barrel (4);

wherein the elastic piece (22) pushes the projectile-loading block (15) to slide toward the barrel (4) along the rail tube (14) when the slider module (20) slides forwards, thereby pushing one projectile (3) into the barrel (4) while closing the projectile chamber (11).

2. The projectile-loading assembly (1) according to claim 1, wherein a top end of the magazine module (10) further comprises an intake portion (16) away from the projectile-loading block (15), the interior of the intake portion (16) has a valve (161) for selectively contacting with the rail tube (14) or separating there from, and an intake chamber (162) surrounding the rail tube (14), a rear end of the intake portion (16) is provided with a perforation (163) aligned with the rail tube (14).

3. The projectile-loading assembly (1) according to claim 2, wherein a rear end of the slider module (20) is connected to a piston (8), the piston (8) has a striking pin (81) for penetrating into the perforation (163) to push the rail tube (14), thereby separating the rail tube (14) and the valve (161).

4. The projectile-loading assembly (1) according to claim 3, wherein the magazine module (10) is provided with an accommodating chamber (13) adjacent to the projectile chamber (11) for accommodating a compressed air can (7), the top of the accommodating chamber (13) is provided with an intake tube (131) for abutting the compressed air can (7) and communicating with the intake chamber (162).

5. The projectile-loading assembly (1) according to claim 4, wherein the high pressurize air in the compressed air can (7) is filled in the intake chamber (162) via the intake tube (131), a portion of the compressed air in the intake chamber (162) enters the rail tube (14) to propel the projectile (3) out of the barrel (4) when the rail tube (14) is pushed by the striking pin (81) to separate from the valve (16), the other portion of the compressed air in the intake chamber (162) is ejected outside the intake chamber (16) via the perforation (163) to force the piston (8) to move rearwards, thereby driving the slider module (20) to slide rearwards.

6. The projectile-loading assembly (1) according to claim 5, wherein an upper edge of the rear end of the barrel (4) is formed with a protrusion (42) adjacent to the projectile-loading block (15), the projectile-loading block (15) comprises a trough (151) engaged with the protrusion (42), and a projectile-locking protrusion (152) located under the trough (151) to be inserted into the barrel (4), the projectile-loading protrusion (152) pushes the projectile (3) into the barrel (4) and closes the projectile chamber (11).

7. The projectile-loading assembly (1) according to claim 6, wherein the interior of the projectile chamber (11) has a projectile-pushing rod (12) for pushing the projectile (3) out of the projectile chamber (11).

* * * * *